US007523517B2

(12) United States Patent
Yu

(10) Patent No.: US 7,523,517 B2
(45) Date of Patent: Apr. 28, 2009

(54) WINDOW CLEANING MACHINE

(75) Inventor: Adam M. Yu, Los Angeles, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 817 days.

(21) Appl. No.: 11/176,547

(22) Filed: Jul. 7, 2005

(65) Prior Publication Data

US 2007/0006408 A1 Jan. 11, 2007

(51) Int. Cl.
*A47L 1/02* (2006.01)

(52) U.S. Cl. ..... 15/103; 15/250.11

(58) Field of Classification Search ..... 15/103, 15/250.047, 50.11, 50.3, 50.1, 250.11, 250.04
See application file for complete search history.

(56) References Cited

U.S. PATENT DOCUMENTS

| | | | | |
|---|---|---|---|---|
| 3,641,607 | A | 2/1972 | Lemelson | |
| 3,887,954 | A * | 6/1975 | Carlsson | 15/50.3 |
| 4,198,724 | A | 4/1980 | Fisher et al. | |
| 4,800,607 | A | 1/1989 | Fukutomi | |
| 4,809,384 | A | 3/1989 | Yokota et al. | |
| 5,216,775 | A | 6/1993 | Takasaki | |
| 5,465,446 | A | 11/1995 | Chang | |
| 5,485,645 | A | 1/1996 | Ohtsuki | |
| 5,655,247 | A | 8/1997 | Allen et al. | |
| 5,715,557 | A | 2/1998 | Hsu | |
| 5,791,862 | A | 8/1998 | Ohtsuki et al. | |
| 5,845,739 | A | 12/1998 | Ohtsuki | |
| 5,890,250 | A | 4/1999 | Lange et al. | |
| 6,170,109 | B1 | 1/2001 | Jesadanont et al. | |
| 6,328,813 | B1 | 12/2001 | Dornier | |
| 6,550,090 | B1 | 4/2003 | Jesadanont et al. | |

FOREIGN PATENT DOCUMENTS

| | | | |
|---|---|---|---|
| EP | 0798429 A1 | | 1/1997 |
| JP | 5-277046 | * | 10/1993 |
| WO | WO 97/33509 | * | 9/1997 |

OTHER PUBLICATIONS

Computer generated English translation of JP 05-277046.*
English translation of WO 97/33509, Dornier, Sep. 18, 1997.*
U.S. Department of Labor, Scaffolding, website www.osha.gov, 2 pages (May 2003).
Arcow, Autonomous Robotic Cleaning of Windows, website www.cradlerunways.com, 3 pages (Apr. 2001).

* cited by examiner

*Primary Examiner*—Laura C Guidotti
(74) *Attorney, Agent, or Firm*—Stetina Brunda Garred & Brucker

(57) ABSTRACT

A machine for cleaning a window is provided which may comprise a chassis, window cleaning apparatus or mechanism, and a makeweight wherein the makeweight counterbalances the weight of the window cleaning apparatus by traversing the chassis in the first and second directions as the cleaning apparatus traverses the chassis in the second and first directions, respectively.

13 Claims, 5 Drawing Sheets

WINDOW CLEANING MACHINE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a window cleaning machine.

Major cities throughout the United States and throughout the world have numerous skyscrapers and other buildings which require cleaning on a periodic basis to ensure that the buildings are presentable to its residence, guests and visitors. To this end, maintenance personnel must constantly clean the interior and exterior surfaces of the building to maintain its cleanliness. One typical method of cleaning the exterior surfaces (e.g., windows, etc.) of the building is by supporting maintenance personnel on a roof top suspended scaffolding as the maintenance personnel manually cleans the windows and exterior surfaces of the building. Unfortunately, this exposes maintenance personnel to environmental conditions such as wind gusts thereby increasing the risk of injury to maintenance personnel. Additionally, maintenance personnel may fall from the suspended scaffolding to the ground resulting in serious injury or death. The U.S. department of health, and more particularly, the Occupational Safety & Health Administration (OSHA) estimates that 2.3 million construction workers work on scaffolding resulting in 4,500 scaffolding related injuries and 50 deaths.

Prior art window cleaning machines have been developed to automatically clean the exterior surfaces (e.g., window, etc.) of buildings, as shown in FIG. 1. These prior art window cleaning machines are safer than manually cleaning because manual cleaning requires maintenance personnel to clean the building windows while supported on a suspended scaffolding, as discussed above, whereas, in automatic cleaning, only the prior window cleaning machine and not maintenance personnel is supported over the side of the building to clean the exterior surfaces of the building.

Prior art window cleaning machines typically are hung over a side of the building via a boom or cantilever. They may be raised or lowered via cabling such that the prior art window cleaning machine may clean the entire vertical height of the building. Prior art window cleaning machines are also able to laterally traverse the side of the building such that the prior art window cleaning machines may clean the entire side of the building. The prior art window cleaning machines may have two speeds at which it laterally traverses the building side. The first speed provides gross lateral movement along the side of the building by rolling the boom along a track attached to the outer perimeter of the building's roof top. The second speed provides minuet lateral movement. This minuet movement is accomplished at the cleaning apparatus of the prior art window cleaning machine. In particular, the cleaning apparatus may comprise a cleaning apparatus and a frame. The cleaning surface may slide between a left side and a right side of the frame.

Unfortunately, prior art window cleaning machines are not stable. They are prone to tipping and the cleaning apparatus may apply uneven pressure on the exterior surface to be cleaned thereby decreasing the effectiveness of the prior art window cleaning machines and possibly breaking the window to be cleaned. In particular, the frame is hung from the boom by two cables. The two cables are attached to lateral distal ends of the frame. The frame then leans/rests on the exterior surface of the building such as the building window via four pads. These pads are typically positioned at the corners of the frame to stabilize the cleaning apparatus and frame as the cleaning apparatus is laterally traversed between the left and right sides of the frame. Since the weight of the cleaning apparatus may be substantial, the center of gravity of the cleaning apparatus may substantially shift the center of gravity of the prior art window cleaning machine as the cleaning apparatus is traversed between the left and right sides of the frame thereby destabilizing the prior art window cleaning machines.

In support thereof, the two left pads increasingly apply a force against the window as the cleaning apparatus traverses from the right side to the left side of the frame. Similarly, the two right pads increasingly apply a force against the window as the cleaning surface traverses from the left side to the right side of the frame. Such movement and uneven pressure applied to the window by the base may cause the prior art window cleaning machines to destabilize thereby tipping as wind gusts blow against the prior art cleaning apparatus. Additionally, the uneven pressure applied to the window by the pads may also vary the amount of pressure applied by the cleaning surface of the cleaning apparatus to the window thereby reducing the effectiveness of the prior art window cleaning machines. Also, if too much pressure is applied to the window via the pads, then the window may break under such excessive pressure.

Accordingly, there is a need in the art for an improved window cleaning machine.

BRIEF SUMMARY

In an aspect of the present invention, a window cleaning machine is provided which is capable of maintaining its center of gravity at a center of a chassis as a cleaning apparatus of the window cleaning machine traverses in a first direction and a second direction to clean an exterior surface of a building. The window cleaning machine is able to substantially maintain its center of gravity at one location by counterbalancing the shifting weight due to the movement of the cleaning apparatus with an opposing movement of a makeweight. For example, the cleaning apparatus may initially be at a left side of the chassis, and the makeweight may be at a right side of the chassis. In this position, the center of gravity of the window cleaning machine may be at the center of the chassis. As the cleaning apparatus traverses to the right side of the chassis, the makeweight traverses to the left side of the chassis. Since the weight of the makeweight is substantially equal to the weight of the cleaning apparatus, any weight shifting due to the movement of the cleaning apparatus is counterbalanced by the opposing movement of the makeweight.

In particular, a machine for cleaning a window is provided which comprises the chassis, window cleaning apparatus, and makeweight. The chassis defines a left side and a right side wherein traversal from the left side to the right side of the chassis defines a first direction and traversal from the right side to the left side of the frame defines a second direction. The window cleaning apparatus may be slideably engageable to the chassis and traverseable in the first and second directions. The makeweight may also be slideably engageable to the chassis and traverseable in the first and second directions. Moreover, the makeweight may be traverseable in the first and second directions as the cleaning apparatus is traversed in the second and first directions, respectively.

The window cleaning apparatus may have a roller assembly comprising a roller to clean the building's exterior surface. The exterior surface of the roller may define a cleaning surface which contacts the building's exterior surface to be cleaned. Additionally, the roller assembly may also comprise a spray nozzle that may be directed to the cleaning surface. The spray nozzle may spray (e.g., stream or mist, etc.) cleaning fluid onto the cleaning surface while the roller cleans the surface to be cleaned.

The window cleaning apparatus may also have first and second squeegee assemblies on the left and right sides of the roller assembly. Each squeegee assembly may comprise a squeegee which may follow behind the path of the roller to wipe away the cleaning fluid used to clean the building's exterior surface.

The cleaning apparatus and the makeweight may be traversed in opposing directions through a system of two racks engaged to a common pinion. In particular, a first rack may be attached to the window cleaning apparatus and a second rack may be attached to the makeweight. The racks may be aligned and engaged to the common pinion such that rotation of the pinion traverses the first rack and the second rack in opposing directions. Furthermore, the window cleaning machine may comprise a motor to drive the pinion in a clockwise direction and a counterclockwise direction.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
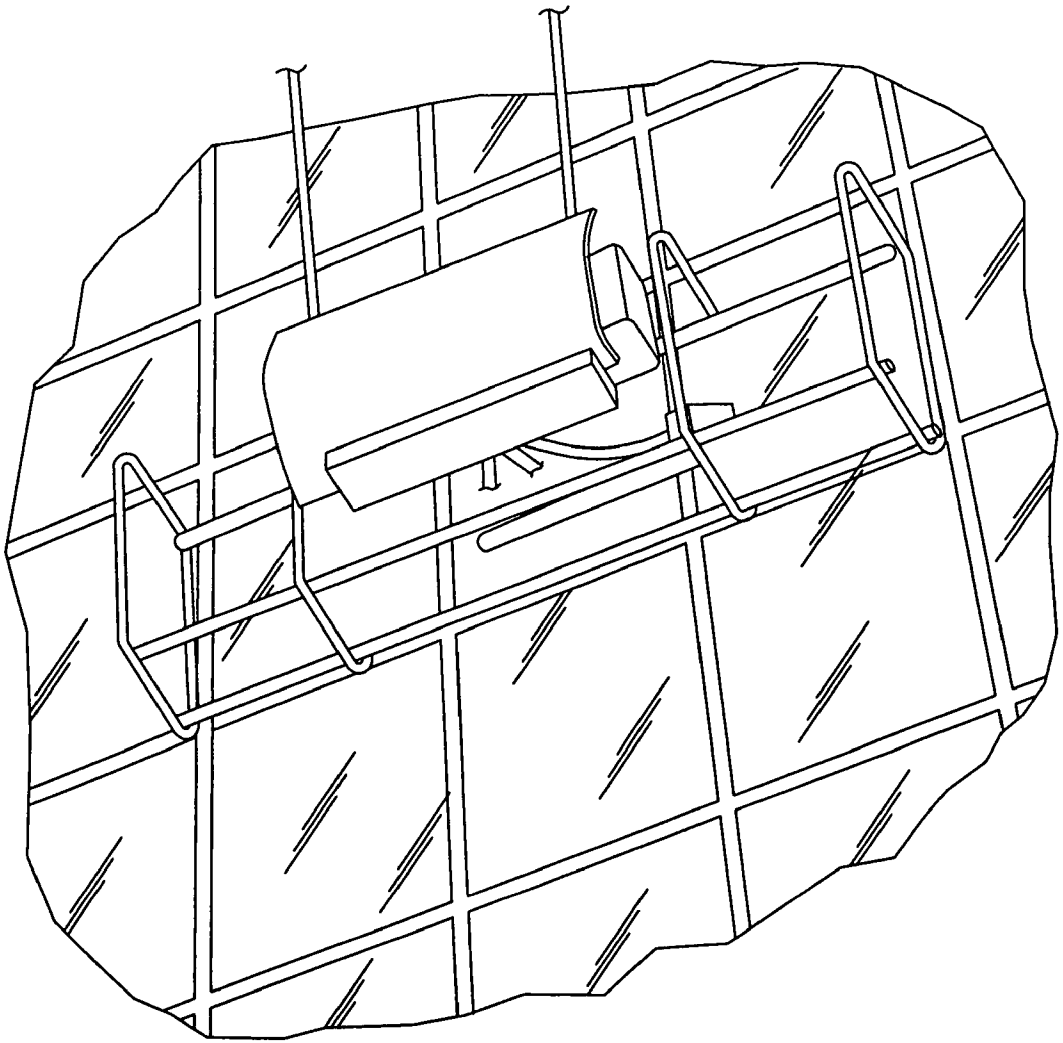
Fig. 1 (PRIOR ART)
FIG. 1 is a perspective view of a prior art window cleaning machine.
Figure 2:
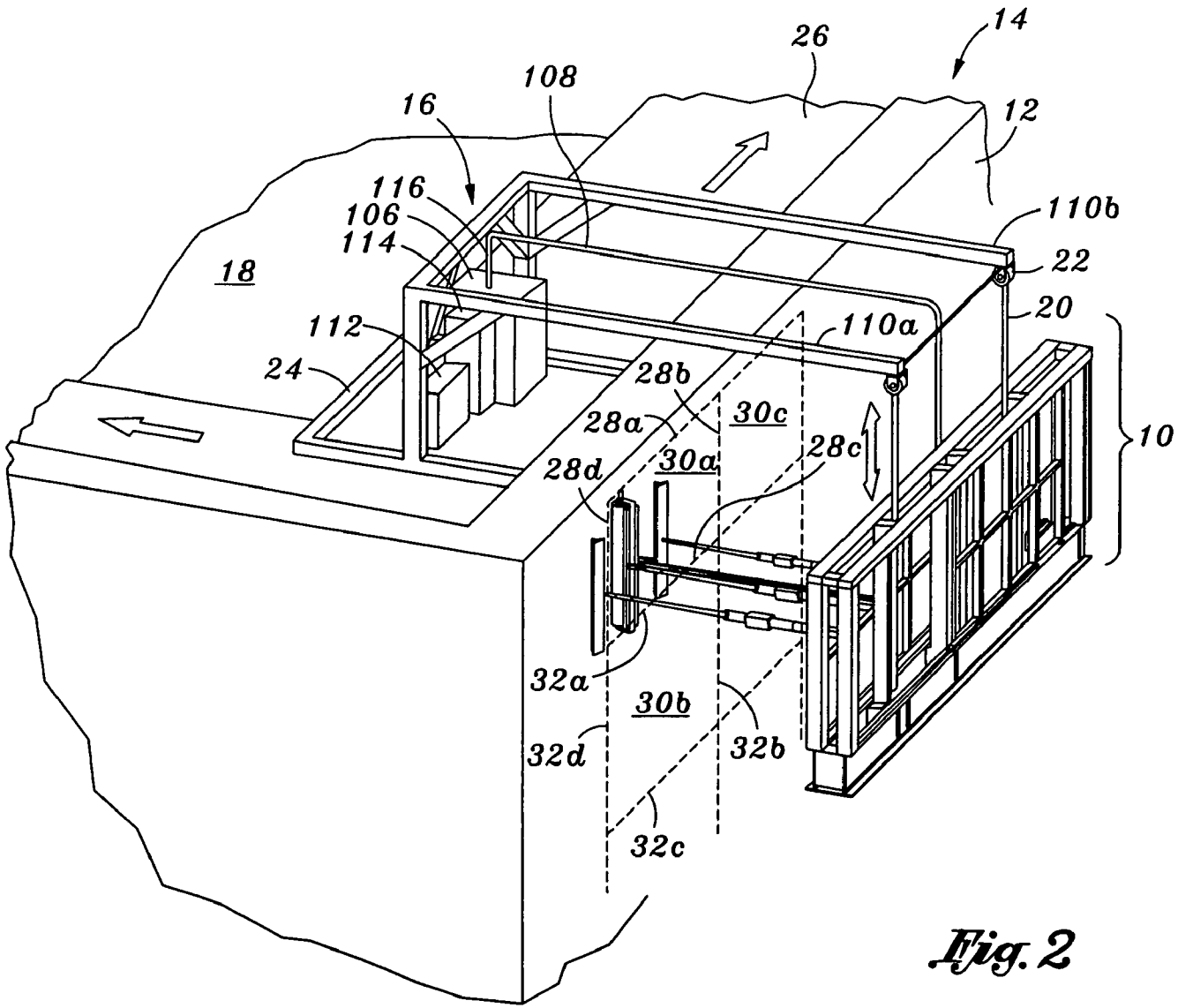
FIG. 2 is a rear perspective view of a window cleaning machine wherein its center of gravity is maintained in a center of a chassis as a cleaning apparatus traverses the chassis in the first and second direction via opposing movement by a makeweight.

Referring now to FIG. 2, a window cleaning machine 10 is supported adjacent a side 12 of a building 14 via an elevator unit 16 attached to the building's roof top 18. The window cleaning machine 10 may be raised and lowered adjacent the building side 12 by the elevator unit 16 through a system of cable 20, pulley 22 and elevator unit motor. The window cleaning machine 10 may be laterally traversed across the building side 12 by moving the elevator unit 16 about an outer perimeter of the building's roof top 18. In this manner, the entire side 12 of the building 14 may be reached by the window cleaning machine 10 to clean the building side 12.

To lower the window cleaning machine 10, the elevator unit motor may unwind the cable 20 from a spool to thread the cable 20 through the pulley 22. The weight of the window cleaning machine 10 pulls down on the cable 20 to maintain tension on the cable 20. Otherwise, the cable 20 may become loose and tangled. To raise the window cleaning machine 10, the elevator unit motor may wind the cable 20 onto the spool with the weight of the window cleaning machine 10 maintaining tension on the cable 10 to prevent tangling thereof.

The window cleaning machine 10 may be laterally traversed across the building side 12 by moving, rolling, or sliding a base 24 of the elevator unit 16 along a track 26. The track 26 may resemble a train track which is attached to the building's roof top 18. The track 26 may be attached to the outer perimeter of the building's roof top 18. In this manner, the track 26 provides a path for the elevator unit 16 to travel about the entire perimeter of the building 14 to clean all sides 12 of the building 14. The base 24 of the elevator unit 16 may have a mechanism which engages the track 26 and may roll along the path of the track 26. The engagement of the track 26 and the mechanism permits the elevator unit 16 and the window cleaning machine 10 to laterally travel across the building's side 12.

The entire side 12 of the building 14 may be cleaned by the window cleaning machine 10 by raising, lowering and laterally traversing the window cleaning machine 10 in a zig-zag pattern. By way of example and not limitation, initially, the window cleaning machine 10 may be located at the top left most corner of the building side 12, as shown in FIG. 2. The window cleaning machine 10 initially cleans an area shown by the enclosed dashed lines 28*a, b, c, d* in FIG. 2. This is the effective cleaning area 30*a* of the window cleaning machine 10. The elevator unit 16 then lowers the window cleaning machine 10 such that its new effective cleaning area 30*b* is below the area 30*a* that was just cleaned. The new effective cleaning area 30*b* is shown by dashed lines 32*a, b, c, d* in FIG. 2. The window cleaning machine 10 may be incrementally lowered down the building's side until an entire column of the building's side 12 is cleaned. Preferably, the window cleaning machine 10 is then raised to the top of the building 14 then laterally traversed such that the effective cleaning area 30*c* of the window cleaning machine 10 is laterally adjacent the cleaned vertical column. The window cleaning machine 10 is then incrementally lowered down the building side 12 until another entire column of the building's side 12 is cleaned. This zig zag process may be repeated until the entire side 12 of the building 14 is cleaned.

The elevator unit 16 may also comprise a brake. The brake prevents the base 24 of the elevator unit 16 from rolling on the track 26. For example, the brake may be a friction pad that presses against the track 26 to stop the elevator unit 16 from moving around while the window cleaning machine 10 is lowered down the side 12 of the building 14. It is also contemplated that the brake may be a pin attached to the elevator unit's base 24 slideably insertable into a hole for receiving the pin. A plurality of the holes may be formed in the track 26 along the entire length of the track 26. The holes may be spaced apart from each other such that the window cleaning machine 10 may be laterally traversed across the building's side 12 as discussed above. To stop the elevator unit 16 from rolling on the track 26, the pin may be inserted into the hole.

Figure 3:
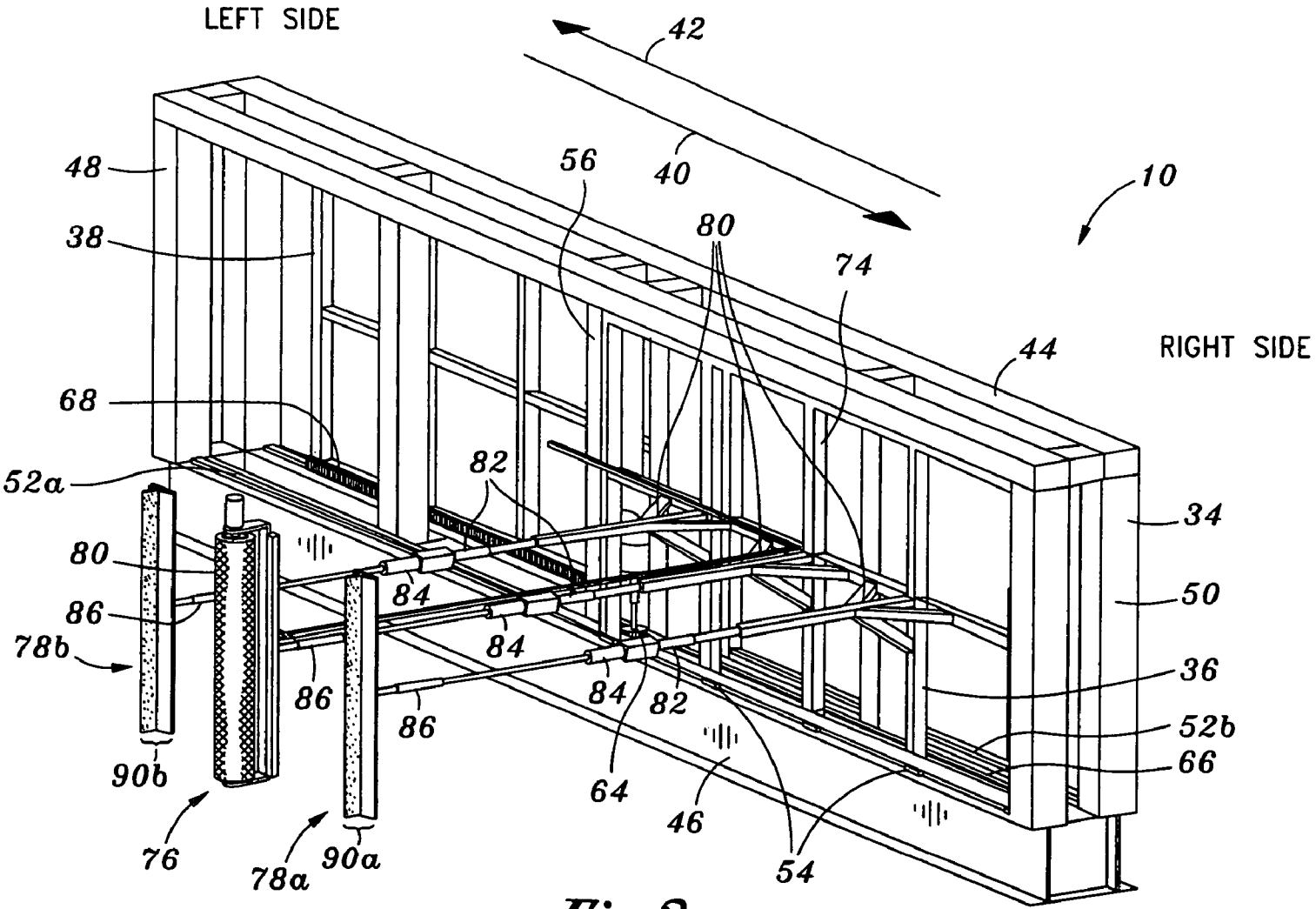
FIG. 3 is a front perspective view of the window cleaning machine of FIG. 2.

Referring now to FIG. 3, the window cleaning machine 10 is more particularly shown as comprising a chassis 34, a window cleaning apparatus 36, and a makeweight 38. The cleaning apparatus 36 laterally traverses the chassis 34 in a first direction 40 and a second direction 42 to clean the effective cleaning area 30. The first direction 40 is defined as traversal from a left side of the chassis 34 to the right side of the chassis 34, and the second direction 42 is defined as traversal from the right side of the chassis 34 to the left side of the chassis 34. Also, the makeweight 38 laterally traverses the chassis 34 in the first direction 40 when the cleaning apparatus 36 traverses the chassis 34 in the second direction 42 and vice versa. The purpose of the makeweight 38 is to maintain the center of gravity of the window cleaning machine 10 as the cleaning apparatus 36 is traversed in the first and second directions 40, 42 to clean the building's side 12. In this way, the window cleaning machine 10 is made more stable and able to clean the building side 12 in a more efficient and more effective manner, as will be discussed further below. Preferably, the window cleaning machine's center of gravity is located at the middle of the chassis 34. Accordingly, as the cleaning apparatus 36 is traversed in the first and second directions 40, 42, the makeweight 38 is correspondingly traversed in the second and first directions 42, 40, respectively to maintain the machine's center of gravity preferably at the middle of the chassis 34.

The chassis 34 may have a rectangular configuration defined by opposed upper and lower horizontal members 44, 46. The horizontal members 44, 46 may be perpendicularly attached to opposed left and right vertical members 48, 50 to form the rectangular configuration. The lower horizontal member 46 may be fabricated from a steel I-beam to prevent the chassis 34 from bending during operation. This permits the cleaning apparatus 36 and the makeweight 38 to easily traverse the chassis 34 in the first and second directions 40, 42. The steel I-beam also adds stability due to its weight (about 1800 lbs) such that wind gusts do not excessively rotate the window cleaning machine. The upper horizontal member 44 may comprise two square tubes that extend over the lower horizontal member 46. The left and right vertical members 48, 50 may also each comprise two square tubes which are attached to the distal ends of the upper and lower horizontal members 44, 46. By way of example and not limitation, the horizontal members 44, 46 may be attached to the vertical members 48, 50 by welding, adhering, etc. The lower horizontal member 46 may have a guide rail 52*a* on the cleaning apparatus side and another guide rail 52*b* on the makeweight side of the chassis 34. The guide rails 52*a, b* engage rolling blocks 54 (discussed below) attached to the cleaning apparatus 36 and the makeweight 38 to permit the cleaning apparatus 36 and the makeweight 38 to traverse the chassis 34 in the first and second directions 40, 42.

Figure 4:
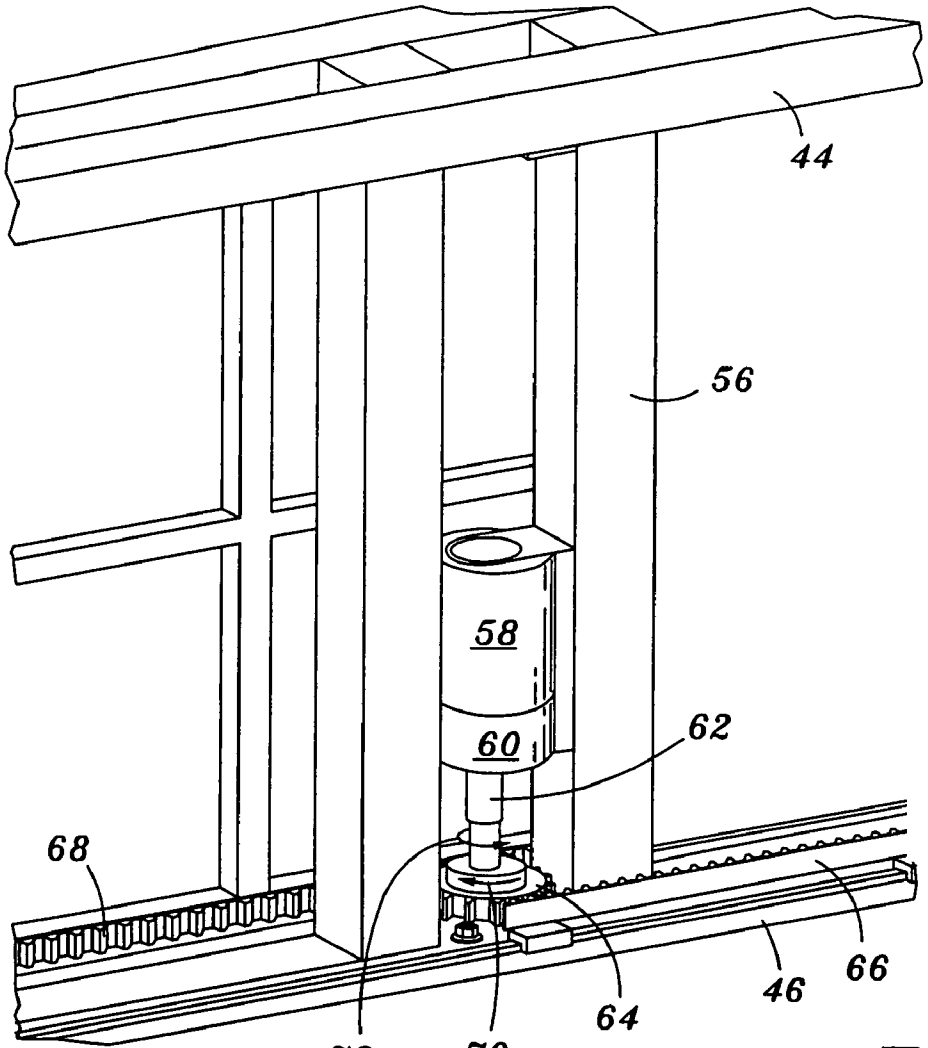
FIG. 4 is a perspective view of a motor which is attached to a rack and pinion assembly to opposingly traverse the makeweight and the cleaning apparatus.

The middle portion of the chassis 34 may additionally have a post 56 vertically oriented and attached to the upper and lower horizontal members 44, 46, as shown in FIGS. 3 and 4. The post 56 adds rigidity to the chassis 34 but also provides a mounting area for a motor 58 to drive the cleaning apparatus 36 and the makeweight 38 in the first and second directions 40, 42, as discussed herein. The motor 58 is mounted to the post 56 and is operative to bi-directionally rotate a reducer 60, connector 62 and a pinion 64 (e.g., spur gear, etc.). The pinion 64 may simultaneously engage a first rack 66 and a second rack 68 attached to the cleaning apparatus 36 and the makeweight 38, respectively. The pinion 64 may also be supported by a plurality of ball bearings to reduce frictional forces that prevent the pinion 64 from rotating. The motor may be a ¼ horsepower DC motor wherein its spindle may rotate in the clockwise direction 70 and the counter-clockwise direction 72.

As shown in FIG. 3, the cleaning apparatus 36 is positioned on the right side and the makeweight 38 is positioned on the left side of the chassis 34. The first rack 66 is attached to the cleaning apparatus 36 at a bottom edge thereof, and the second rack 68 is attached to the makeweight 38 at the lower edge thereof. When the pinion 64 is rotated in the clockwise direction 70, the cleaning apparatus and the makeweight traverse the chassis in the second and first directions 42, 40, respectively. When the cleaning apparatus 36 and the makeweight 38 have fully traversed the second and first directions 42, 40, respectively, the pinion's direction may be reversed to the counterclockwise direction 72 so as to traverse the cleaning apparatus 36 and the makeweight 38 in first and second directions 40, 42, respectively. In this manner, the center of gravity of the machine 10 is maintained as the cleaning apparatus 36 traverses the chassis 34 in the first and second directions 40, 42.

The cleaning apparatus 36 may comprise a subframe 74, roller assembly 76 and first and second squeegee assemblies 78*a, b*. The subframe 74 may be a plurality of vertical and horizontal members which are attached or otherwise fixed to each other in a window pane configuration. The subframe 74 may have a generally rectangular configuration. The upper and lower members of the subframe may each have at least two rolling blocks 54 attached thereto. These rolling blocks 54 may engage and slide along the guide rails 52 to enable the subframe 74 to traverse the chassis 34 in the first and second directions 40, 42. The subframe 74 may be fabricated from a lightweight material such as aluminum tubes.

The roller assembly 76 and the first and second squeegee assemblies 78*a, b* may be attached to the subframe 74. Each of the assemblies 46, 78*a*, 78*b* may have a base 80, a linear connector 82, a linear translator 84 and a corresponding roller or squeegee connector 86 which are interconnected to each other. Also, the base 80 may be attached to the subframe 74. The corresponding roller or squeegee connector 86 may have a sensor which senses the pressure applied to the window by the roller 88 or squeegee 90. When the pressure sensor senses that the pressure applied to the window by the roller 88 or squeegee 90 is too high (e.g., sufficient to crack the window glass, etc.) then the linear translator 84 may retract the roller 88 or squeegee 90 such that the roller 88 or squeegee 90 applies less pressure to the building's exterior. Conversely, when the pressure sensor senses that the pressure applied to the window by the roller 88 or squeegee 90 is too low (e.g., not sufficient to clean or wipe the building's exterior, etc.) then the linear translator 84 may extend the roller 88 or squeegee 90 such that the roller 88 or squeegee 90 applies more pressure to the building's exterior. The linear translators 84 may also retract the roller 88 and the squeegees 90 such that the same does not interfere with any protuberances on the building's side 12 when the window cleaning machine 10 is being raised, lowered and laterally traversed.

The linear connector 82 may have a spring damper to adjust the pressure on the building's exterior exerted by the roller 88 or squeegee 90. Accordingly, the linear translator 85 may initially extend the roller 88 and one of the squeegees 90 onto the building's exterior. The spring damper maintains a working pressure applied on the window by the squeegee 90 and the roller 88. As the window cleaning machine 10 is suspended over the building's side 12, wind gusts may blow on the window cleaning machine 10 thereby rotating the window cleaning machine 10 and causing the roller 88 and the squeegees 90 to apply more pressure onto the window. The sensor senses such increased pressure, and the linear translator 84 retracts the roller 88 and/or squeegee 90 in response to such increased pressure such that the pressure applied to the window by the roller 88 and/or squeegee 90 is within the working pressure, and vice versa.

Figure 5:
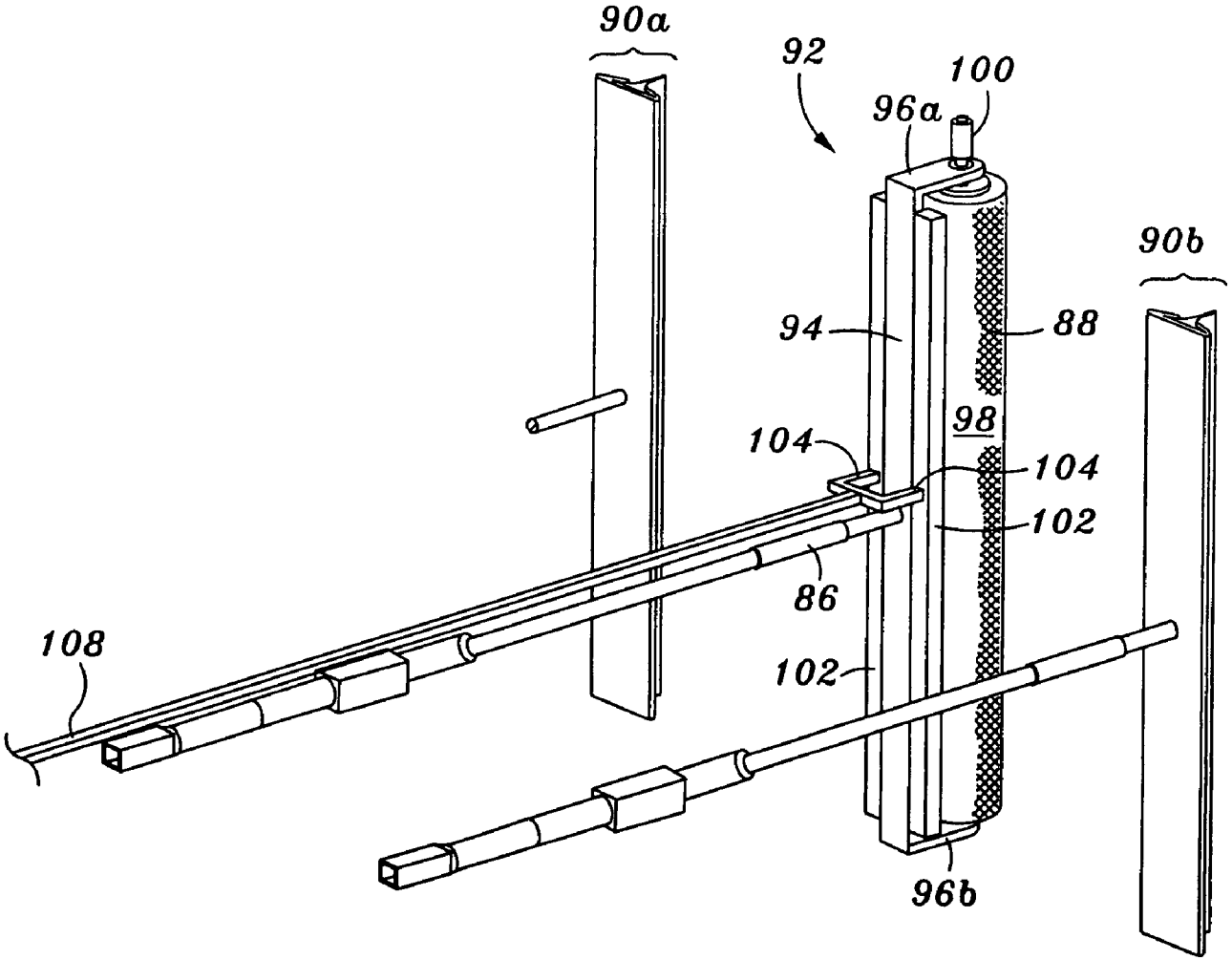
FIG. 5 is a perspective view of a roller assembly and squeegee assembly.

As shown in FIG. 5, the roller 88 may be connected to the roller connector 86 which may be connected to a bracket 92. The bracket 92 may have a support member 94 connected to two tines 96*a, b*. The support member 94 may be fixedly connected to the roller connector 86, and the two tines 96*a, b* may rotationally hold distal ends of the roller 88. The roller 88 may have a soft, plush, absorbent outer exterior defining the cleaning surface 98 of the roller 88. By way of example, the roller's cleaning surface 98 may be an extra light round brush type nylon material. The roller 88 may also have a shaft about which the cleaning surface 98 rotates. Each of the tines 96*a, b* may have a roller ball bearing which may engage distal ends of the roller shaft to allow the roller 88 to rotate about the shaft.

An upper tine 96*a* may be have a roller motor 100 attached thereto. The roller motor 100 may be an AC motor. The roller motor 100 may be operative to rotate the roller 88 in either a clockwise direction 70 or a counter clockwise direction 72. By way of example and not limitation, the roller motor 100 may be a one tenth (1/10) horsepower AC motor. It is also contemplated that the roller motor 100 be operative to rotate the roller 88 in both the clockwise direction 70 as well as the counter clockwise direction 72. In this regard, the roller motor may be a DC motor. The roller motor 100 (e.g., DC motor) may rotate the roller 88 in the clockwise direction 70 or the clockwise direction 72 depending on whether the cleaning apparatus 36 is traveling in the first or the second direction 40, 42.

The roller assembly 76 may also comprise a spray nozzle 102 (see FIG. 5). One spray nozzle 102 may be positioned on each side of the support member 94. The spray nozzle 102 may be a plurality of holes which enable cleaning fluid to be dispersed therethrough onto the entire length of the roller's cleaning surface 98. In particular, the spray nozzle 102 may be attached to the support member 94 of the bracket 92. The spray nozzle 102 may extend substantially between the two tines 96*a, b* with the plurality of holes evenly distributed therebetween. Each of the holes may be sized and configured to spray a mist or a stream of cleaning fluid onto the cleaning surface 98 when an inlet 104 of the spray nozzle 102 is pressurized.

The spray nozzle 102 may be fluidically connected to the mixing tank 106 located at the base 24 of the elevator unit 16. (see FIGS. 2 and 5). In particular, the mixing tank 106 may have a hose 108 that extends from the mixing tank 106 to the inlet 104 of the spray nozzle 102. The hose 108 may be retracted onto a spool located on the base 24 when the window cleaning machine 10 is raised to the building's top. Conversely, the hose 108 may be extended off of the spool as the window cleaning machine 10 is lowered down the side 12 of the building 14. The hose 108 may be fabricated from a weather resistant material such as rubber to resist the harsh environment.

Each of the squeegee assemblies 78*a, b* may further comprise a squeegee 90*a, b*. The squeegee 90*a, b* is operative to wipe off the cleaning fluid applied to the building's exterior by the roller's cleaning surface 98. The squeegee 90*a, b* may be an elongated rubber strip which may follow behind the roller path and wipes the cleaning fluid off of the building's exterior.

As shown in FIG. 3, a first squeegee assembly 78*a* may be positioned on the left side of the roller assembly 76, and a second squeegee assembly 78*b* may be positioned on the right side of the roller assembly 76. The first and second squeegees 78*a, b* may each have a retracted position and an extended position. In the retracted position, the squeegees 78*a, b* do not contact the building's exterior and does not interfere with any protuberances of the building's side as the window cleaning machine 10 is raised, lowered and laterally traversed across the building's side. In the extended position, the squeegee 90*a, b* may apply a working pressure onto the building's exterior to wipe cleaning fluid off of the building's exterior. In particular, referring to FIGS. 2 and 3, as the cleaning apparatus 36 is traversed in the second direction 42, the second squeegee assembly 78*b* is in the retracted position and the first squeegee assembly 78*a* is in the extended position. In practice, the roller 88 (see FIG. 5) soaked with cleaning fluid cleans the effective cleaning area 30 then the first squeegee 90*a* wipes away the excess cleaning fluid. Conversely, as the cleaning apparatus 36 is traversed in the first direction 40, the first squeegee assembly 78*a* is in the retracted position and the second squeegee 78*b* is in the extended position. In this manner, the second squeegee assembly 78*b* wipes any excess cleaning fluid off of the building's exterior after the roller 88 (see FIG. 5) has cleaned the effective cleaning area 30.

The makeweight 38 may have a substantially similar construction compared to the subframe 74 of the cleaning apparatus 36. In particular, the makeweight 38 may comprise a plurality of vertical and horizontal members that are attached to each other in a window pane configuration. The makeweight 38 may weigh about the sum of the weights of the subframe 74, roller assembly 76 and the first and second squeegee assemblies 78*a, b*.

In use, the window cleaning assembly's design allows the roller 88 and the squeegees 90*a, b* to apply consistent pressure on the building's exterior to effectively clean such surface. In particular, the chassis 34 may be at least partially fabricated from a steel I beam which may weigh about 1800 pounds. Additionally, the cleaning apparatus 36 and the makeweight 38 both may have a porous configuration (e.g., window pane configuration, etc.) to allow wind gusts to pass therethrough. These two aspects of the window cleaning machine 10 provide for a stable platform to mount the roller 88 and the squeegees 90*a, b* because the wind gusts pass through the cleaning apparatus 36 and the makeweight 38 to minimize any chassis movement caused by the wind gusts. The window cleaning machine 10, and more particularly, the roller assembly 76 and squeegee assemblies 78*a, b* each comprise a sensor and linear translator 84 combination to fine tune the pressure applied to the building's exterior by the roller 88 and squeegees 90*a, b*. Finally, pressure applied onto the building exterior is further controlled or enhanced because the center of gravity of the window cleaning machine 10 may be substantially maintained at the center of the chassis as the cleaning apparatus 36 is traversed in the first and second directions 40, 42.

The elevator unit 16 may comprise the base 24 and two booms 110*a, b* which extend out over the building's side 12. Pulleys 22 are attached to the distal ends of the booms 110*a, b* and have cable 20 threaded therethrough. The cables 20 support the window cleaning machine 10 above the ground and adjacent the building's side 12. The motor winds and unwinds the cable 20 onto the spool to raise or lower the window cleaning machine 10.

The elevator unit 16 may also comprise a control unit 112 (see FIG. 2). The control unit 112 may be in electrical communication with each subunit of the window cleaning machine 10 such as the linear translators, motors, and pumps. Additionally, each sub unit may have its own sub controller. The control unit in conjunction with the sub controllers may control the operation of the window cleaning assembly. For example, the linear translators of the roller and squeegee assemblies 76, 78*a*, 78*b* may have its own subcontroller. This enables the linear translators to better react to wind gusts and movements of the chassis.

Referring to FIG. 2, the cleaning fluid applied to the roller 88 may be a liquid solution. By way of example, the solution may be a mixture of ammonia and water. The ammonia and the water may be mixed together in the water and chemical mixing unit 106 which may be located at the base 24 of the elevator unit 16. In particular, undiluted ammonia may be added to the chemical tank 114. The chemical tank 114 may be fluidically communicable with the mixing unit 106. The mixing unit 106 may also be fluidically communicable with a water source such as the building's water supply. Initially, ammonia may be added to the mixing unit 106. Thereafter, water may be added to the mixing unit 106. The amount of water and ammonia added to mixing unit may be effective amounts of each for the window cleaning machine 10 to clean the building's exterior surfaces. To mix the ammonia and the water in the mixing unit 106, blades that resemble fan blades may be submerged into the mixture of water and ammonia and rotated to mix the ammonia and the water. The mixing unit 106 may additionally have a pump to transfer the mixed solution through the mixing unit's outlet 116, through the hose 108 and spray nozzle 102 and onto the cleaning surface 98.

The above description is given by way of example, and not limitation. Given the above disclosure, one skilled in the art could devise variations that are within the scope and spirit of the invention disclosed herein, including various ways of raising and lower the window cleaning machine 10 as well as laterally traversing the window cleaning machine 10 across the side 12 of the building 14. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A machine for cleaning a window, the machine comprising:

a chassis defining a left side and a right side wherein traversal from the left side to the right side of the chassis defines a first direction and traversal from the right side to the left side of the chassis defines a second direction;

a window cleaning apparatus slideably engageable to the chassis and traversable in the first and second directions;

a makeweight slideably engageable to the chassis, the makeweight being traversable in the second direction as the window cleaning apparatus is traversed in the first direction and traversable in the first direction as the window cleaning apparatus is traversed in the second direction;

wherein the makeweight counterbalances a weight of the window cleaning apparatus as the window cleaning apparatus is traversed in the first and second directions.

2. The machine of claim 1 wherein the window cleaning apparatus comprises:

a cleaning surface that contacts the window while traversing thereacross to clean the window; and a spray nozzle directed toward the cleaning surface for applying a cleaning fluid to the cleaning surface while the cleaning surface is cleaning the window.

3. The machine of claim 1 wherein the chassis comprises:

a pair of opposed vertical members;

a pair of opposed upper and lower horizontal members, the lower horizontal member being fabricated from a steel I beam;

wherein distal ends of the vertical members are perpendicularly fixed to the distal ends of the horizontal posts.

4. The machine of claim 1 further comprising:

a first gear rack attached to the window cleaning apparatus;

a pinion gear engaged to the first gear rack and operative to traverse the window cleaning apparatus in the first direction and the second direction;

a second gear rack engaged to the pinion gear opposite the first gear rack and attached to the makeweight;

wherein rotation of the pinion gear traverses the first rack attached to the window cleaning apparatus and the second rack attached to the makeweight in opposing directions such that the makeweight counterbalances any weight shifting due to traversal of the first gear rack.

5. The machine of claim 4 further comprising:

a motor connected to the pinion gear and operative to rotate the pinion gear in a clockwise direction and a counterclockwise direction.

6. The machine of claim 5 wherein the motor is a one quarter horsepower direct current motor.

7. The machine of claim 1 wherein the window cleaning apparatus comprises a subframe.

8. The machine of claim 7 wherein the subframe is a plurality of horizontal and vertical bars attached to each other in a window pane configuration, the subframe being slideably engageable along a first guide rail attached to the chassis.

9. The machine of claim 8 wherein the makeweight is a plurality of horizontal and vertical bars attached to each other in a window pane configuration, the makeweight being slideably engageable along a second guide rail attached to the chassis.

10. A window cleaning machine for cleaning a window of a building, the machine comprising:

a chassis defining a left side and a right side wherein traversal from the left side to the right side of the chassis defines a first direction and traversal from the right side to the left side of the chassis defines a second direction;

a window cleaning apparatus slideably engageable to the chassis and traversable in the first and second directions, the window cleaning apparatus comprising:

a roller defining a cleaning surface;

a spray nozzle disposed adjacent to the cleaning surface for applying a cleaning fluid on the cleaning surface or the window;

a first squeegee having an extended position and a retracted position, the first squeegee being positioned on the right side of the chassis;

a second squeegee having an extended position and a retracted position, the second squeegee being positioned on the left side of the chassis;

wherein the first squeegee is in the extended position and the second squeegee is in the retracted position when the cleaning apparatus is traversed in the second direction, and the second squeegee is in the extended position and the first squeegee is in the retracted position when the cleaning apparatus is traversed in the first direction.

11. The machine of claim 10 wherein the roller has an extended position and a retracted position, and the roller, first squeegee, and second squeegee does not interfere with any protuberances of the building when the roller, first squeegee and second squeegee are in the retracted position.

12. The machine of claim 10 wherein the roller is a soft absorbent material.

13. The machine of claim 10 wherein the spray nozzle is a plurality of holes extending along the length of the roller.

* * * * *